United States Patent [19]

Freeman

[11] Patent Number: 4,570,268

[45] Date of Patent: Feb. 18, 1986

[54] PATIENT'S GARMENT

[76] Inventor: James J. Freeman, 19 Willowlawn Ave., Buffalo, N.Y. 14214

[21] Appl. No.: 558,799

[22] Filed: Dec. 7, 1983

[51] Int. Cl.[4] ..... A41B 9/00

[52] U.S. Cl. ..... 2/114; 2/DIG. 7; 2/74

[58] Field of Search ..... 2/DIG. 7, 114, 76, 69, 2/105

[56] References Cited

U.S. PATENT DOCUMENTS

| | | | |
|---|---|---|---|
| D. 233,634 | 11/1974 | Snider | D2/17 |
| 1,396,619 | 11/1921 | Alleigh | 2/76 |
| 2,260,168 | 10/1941 | Costana | 2/76 |
| 2,701,364 | 2/1955 | Palm | 2/DIG. 7 |
| 2,807,022 | 9/1957 | Bonanni | 2/114 |
| 2,818,573 | 6/1956 | O'Donnell | 2/114 |
| 3,230,545 | 1/1966 | Galley | 2/114 |
| 3,259,913 | 7/1966 | Tames | 2/114 |
| 3,464,063 | 9/1969 | Hoegerman | 2/114 |
| 3,490,072 | 1/1970 | Keltner | 2/114 |
| 3,574,864 | 4/1971 | Bradley | 2/114 |
| 3,745,587 | 7/1973 | Bradley | 2/114 |
| 3,748,659 | 7/1973 | Meyers | 2/74 |
| 3,824,625 | 7/1974 | Green | 2/114 |
| 3,843,971 | 10/1974 | Delanty et al. | 2/114 |
| 3,911,499 | 10/1975 | Benevento et al. | 2/114 |
| 4,382,303 | 5/1983 | Lunt | 2/114 |
| 4,422,186 | 12/1983 | Loney | 2/114 |

FOREIGN PATENT DOCUMENTS

| | | | |
|---|---|---|---|
| 903022 | 1/1945 | France | 2/114 |

*Primary Examiner*—Doris L. Troutman

*Attorney, Agent, or Firm*—Christel, Bean & Linihan

[57] ABSTRACT

A patient's garment which is suitable for various medical procedures, which will give the patient a sense of dignity and well-being, and which is of relatively low cost, high durability and common sizing. The patient's garment has a body portion (10) and sleeves (14). The body portion includes a main panel (16) which can be positioned to either the front or rear side of the patient and a pair of adjacent side panels (18, 20) which would normally be positioned on the other side of the patient. The outer side edges (28, 30) of the side panels are joined together in overlapping relationship when the garment is worn by the patient by a plurality of vertically spaced apart fasteners (42, 44). The sleeves 14 are sewn to the body portion, and the top of each sleeve is provided with an openable seam having adjacent mating edges (34, 36) which extend from the neck of the patient over the patient's shoulder and down along the arms. The mating edges can be held together in overlapping relationship by a plurality of spaced apart hook and loop fasteners (56, 58). The fasteners can be opened to facilitate various hospital procedures such as X-rays, thorax and upper abdomen examinations, and I.V. therapy, and also permits a mother to nurse her baby without removal of the garment.

14 Claims, 10 Drawing Figures

Fig. 1.
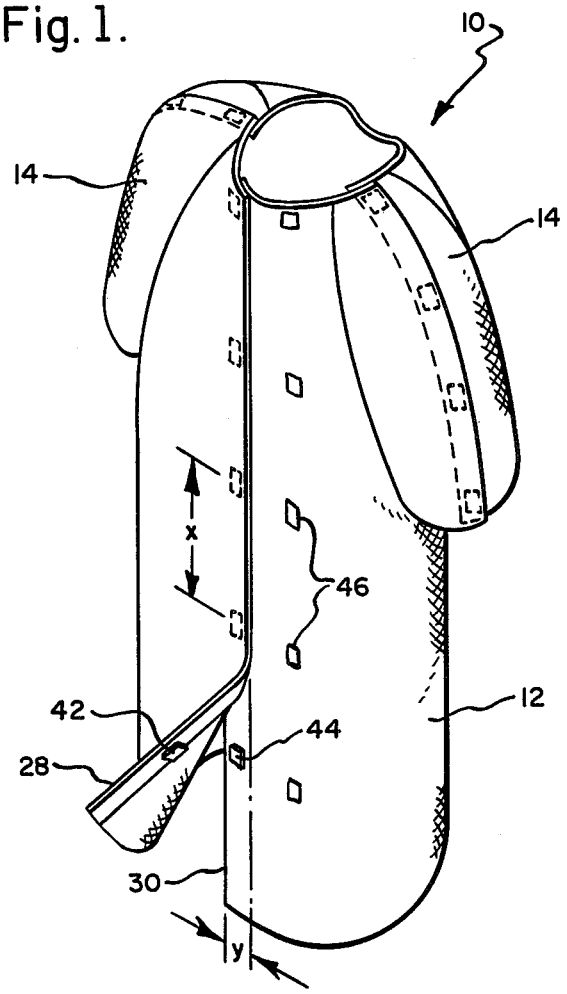
Fig. 5.
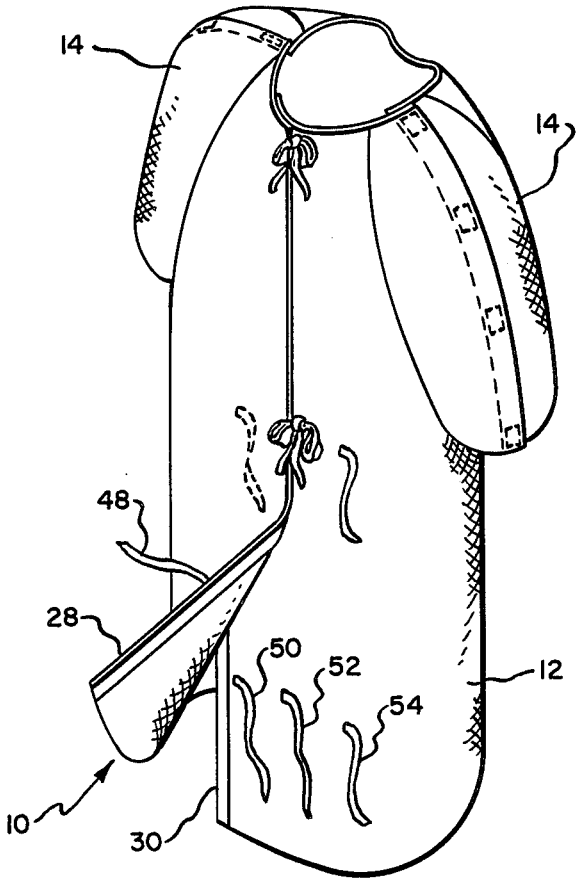
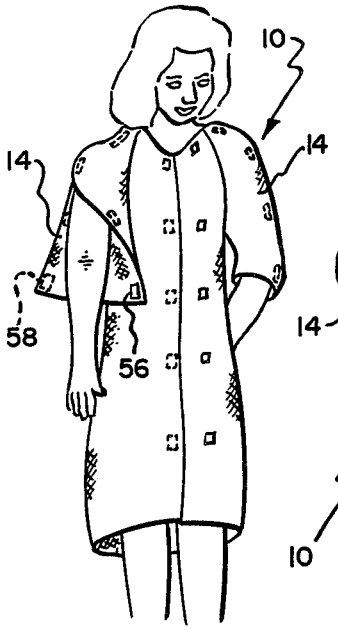
Fig. 3.
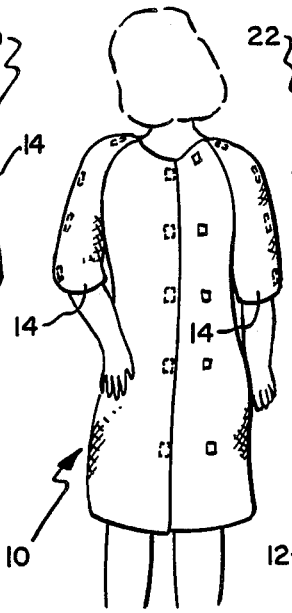
Fig. 4.
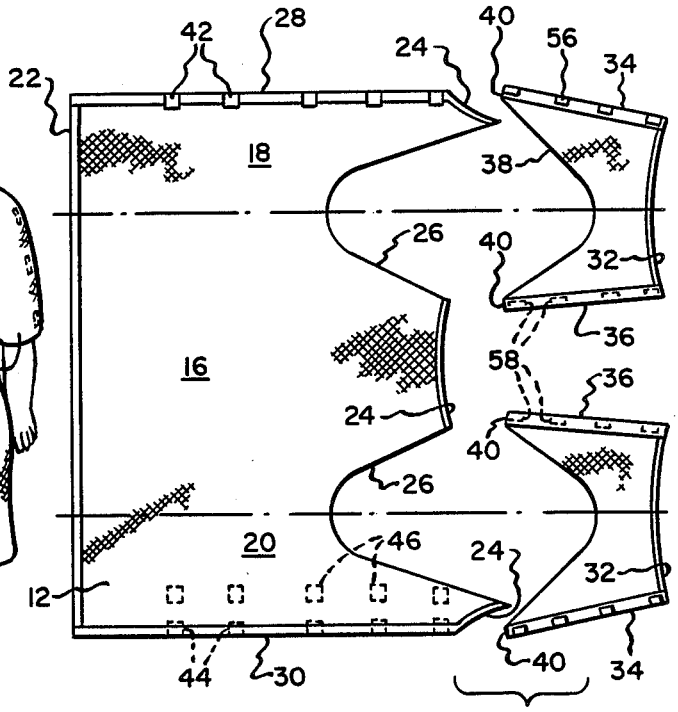
Fig. 2.

PATIENT'S GARMENT

FIELD OF THE INVENTION

The present invention relates generally to a patient's garment, and more particularly to a patient's garment which may be reversed for use as either a housecoast or a hospital gown, which may be worn with comfort and dignity, which is suitable for use for prolonged convalescence, which also permits a wide variety of medical procedures, such as X-ray, to be performed without removal of the hospital gown, and additionally, which will also permit continuation of medical procedures such as I.V. while the garment is being removed.

BACKGROUND OF THE INVENTION

The typical hospital gown in widespread usage today consists essentially of a garment having a body portion and sleeves which are both short in length and wide in width. The body portion is typically formed from a single piece of material and extends from the wearer's neck to a location approximately in the vicinity of the wearer's knees. The side edges of the body portion are joined together at their marginal edges by an upper tie behind the wearer's neck, and by another tie at a location approximately midway down the wearer's back. This gown has been designed to meet various medical and hospital requirements. Hospital administrators like such gowns because they are relatively inexpensive, have a relatively high degree of durability through repeated washings, and need not be stocked in a wide variety of sizes. This same gown is also accepted by most doctors as it permits examination of most portions of the body without removal of the gown. In addition, this gown is also suitable for use during X-rays and for entry into surgical suites as it contains no metal which could either image upon X-ray film or conduct electricity. The sleeves are made short and loose to facilitate the taking of blood pressure and also to permit the continued use of an intravenous bottle while changing the garment; although with some patients who have very large diameter upper arms, it may be necessary to discontinue the I.V. or cut the sleeve of the gown. However, it is frequently necessary to remove this garment. For example, it is not possible for a mother to comfortably nurse her infant without removal of the gown. Many examinations, particularly of the thorax and upper abdomen, also require removal of the gown.

In recognition of the last-mentioned defects of the gown, another gown has been developed and used commercially. This gown resembles the standard hospital gown referred to above in its general cut although the back is secured by two metal snap fasteners instead of ties. In addition each sleeve was provided with an openable seam which extended from the neck of the patient over both shoulders and down the sleeves, the edges of the seam normally being held together by snap fasteners. While this garment permits examinations of the thorax and upper abdomen and also permits nursing mothers to suckle their infants, it does not overcome many of the inherent disadvantages of the standard hospital gown and added additional disadvantages of its own. Thus, the metal snap fasteners rendered the garment unsuitable for use in X-ray and/or surgical suites because of their ability to either image on X-ray or conduct electricity. Furthermore, the snap fasteners do not have good durability when washed in commercial washing machines and frequently become deformed to such as extent that they will not close or open properly.

A variation of the above-described gown is shown in U.S. Pat. No. Des. 233,634 issued Nov. 19, 1974. In the patented design the metal snap fasteners have been replaced by either ties or hook and loop fasteners of the type sold under the trade name "Velcro". Thus "Velcro" fasteners extend the full length of the openable seams in the sleeve, and the side marginal edges of the body portion of the gown can be secured by ties in the upper portion and by spaced apart "Velcro" fasteners in the lower portion.

The standard hospital gown and the ones just described above have a substantial problem in that patients are simply not comfortable wearing them. None of these gowns are particularly suitable for a long term convalescence, as the patients's posterior is frequently in contact with the bedsheets, and this renders many patients uncomfortable in the bed. In addition, as the patient moves about the hospital, the gown frequently parts to the posterior of the patient, subjecting the patient to unnecessary drafts. The patient may also be embarrassed to have his, or particularly her, posterior exposed as they move about the hospital. This embarrassment will actually cause some prospective patients to avoid entering a hospital. Additionally, the standard hospital gown's lack of comfort and tendency to expose the wearer to view also causes many patients to provide their own bedclothing during periods of convalescence, which clothing may not be suitable for hospital procedures and/or examinations and may not be a sterile as the gowns provided by the hospital.

With further reference to U.S. Pat. No. Des. 233,634, the full length shoulder sleeve fasteners will tend to cause unnecessary discomfort to the patient and will also cause a seal which diminishes room temperature air conditioning in this area of the garment thereby promoting increments in body heat which may cause interference with the tape adhesiveness in the various upper thorax treatment and diagnostic sites. Additionally, because of the full length nature of the "Velcro" fasteners, any part which becomes damaged through wear or laundry trauma will thereby mandate that the entire fastener be removed.

It is has been observed that a patient's recovery is tied in to his or her sense of well-being and personal dignity. If the patient feels that he or she is not putting forward that appearance which they want to put forward, their recovery may be delayed.

OBJECTS AND SUMMARY OF THE INVENTION

It is a principal object of the present invention to provide a new design of hospital garment which will meet all criteria required of such a garment, and particularly that criteria established by hospital administrators, doctors, and also by patients.

More particularly, it is an object of the present invention to provide a novel hospital garment of a relatively low cost, high durability, common sizing, which will facilitate hospital examinations and procedures and which will additionally give the patient a sense of dignity and well-being.

The above objects and other objects and advantages of the present invention are accomplished by providing a patient's garment having a body portion and sleeves. The body portion includes a main continuous panel which can be positioned to either the front or rear side of the patient, and a pair of adjacent side panels which would be normally positioned on the other side, each of the panels having a vertically extending marginal outer side edge. When the garment is worn by a patient, it extends from the neck of the patient to about the patient's knees. The outer side edges are joined together in overlapping relationship with each other by a plurality of vertically spaced apart fasteners which may be of the type formed by hook and loop pile or tape. This construction facilitates donning and removal of the gown and also prevents the side panels from gapping open, which preserves the patients's sense of dignity and also provides a greater degree of comfort when worn in the bed during convalescence or when moving from one location to another in a hospital or doctor's office. The sleeves are sewn to the body portion, and the top of each sleeve is provided with adjacent mating edges which can be held together in overlapping relationship by a plurality of spaced apart hook and loop tape fasteners, the mating edges extending from the neck of the patient over the patients's shoulders and down along the arms. The fasteners can be opened to facilitate various hospital procedures such as X-rays, thorax and upper abdomen examinations, and I.V. therapy, and also permits a mother to nurse her baby without removing the gown.

BRIEF DESCRIPTION OF THE VARIOUS FIGURES

FIG. 1 is a perspective view of a first modification of the patient's garment as it would appear when worn by a patient, this modification being provided only with hook and loop pile fasteners.

FIG. 2 is a disassembled view of the garment shown in FIG. 1.

FIG. 3 is a view of the garment shown in FIG. 1 when worn as a housecoat, one of the sleeves being partially open.

FIG. 4 is a view of the garment shown in FIG. 1 when worn as a gown.

FIG. 5 is a view similar to FIG. 1 showing a second modification of the patient's garment, this modification being provided in part with tie fasteners.

DETAILED DESCRIPTION

Figure 6:
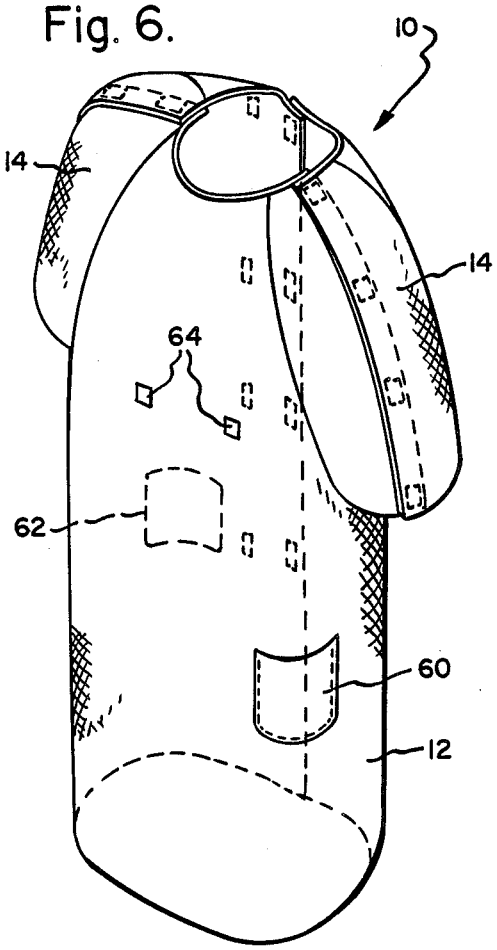
FIG. 6 is a view similar to FIG. 1 showing a third modification of the patient's gown, this modification being provided with pectoral fasteners capable of holding the sleeves open, and also being provided with patch pockets.

In the various modifications shown in the various drawings like reference numerals will be used to illustrate like parts.

The patient's garment illustrated in the various figures and indicated generally at 10 is formed from a main body portion 12, a pair of sleeve portions 14, and various fasteners which are secured to either the body portion 12 of the sleeve portion 14. Both the body portion 12 and the sleeve portions 14 are selected from materials which have suitable characteristics. For example, the material which forms the garment should have a degree of opacity which provides the average patient with a sense of privacy. Additionally, the material should be comfortable when placed against the skin, as the garments will frequently be worn by patients during extended periods of convalescense. In addition, the material should have suitable thermal characteristics so that the patient is comfortable both when in a bed, as for example during sleep periods, or when moving about a hospital from one location to another. Additionally, the material should be of relatively low cost and high durability. The material should also be selected so that it can be easily sewn together and maintained in shape through many washings. Such a material would be a 50% cotton 50% polyester blend. While the above material has been found to be suitable, it should be recognized that many other forms of materials may be utilized providing that they have the desired characteristics.

Figure 8:
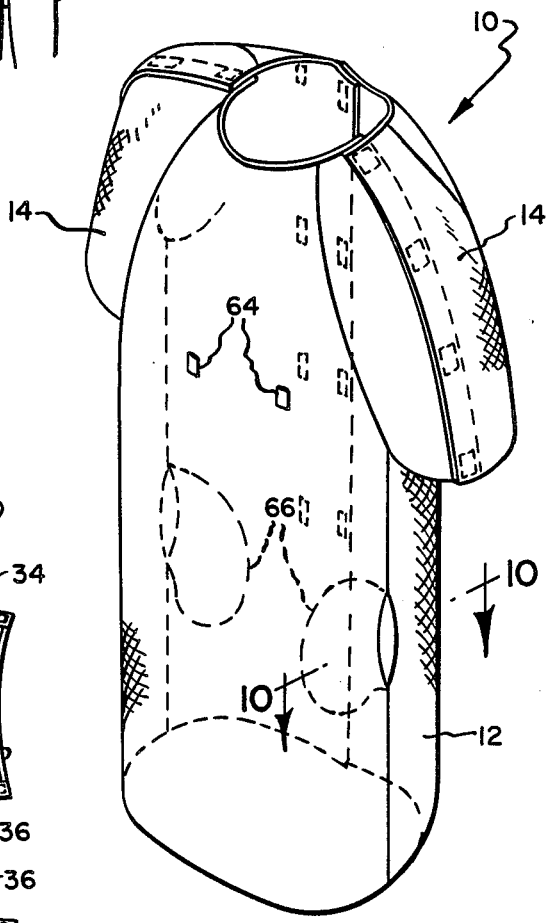
FIG. 8 is a view similar to FIG. 1 showing a fourth modification of the patient's gown, this modification being provided with slash pockets.
Figure 9:
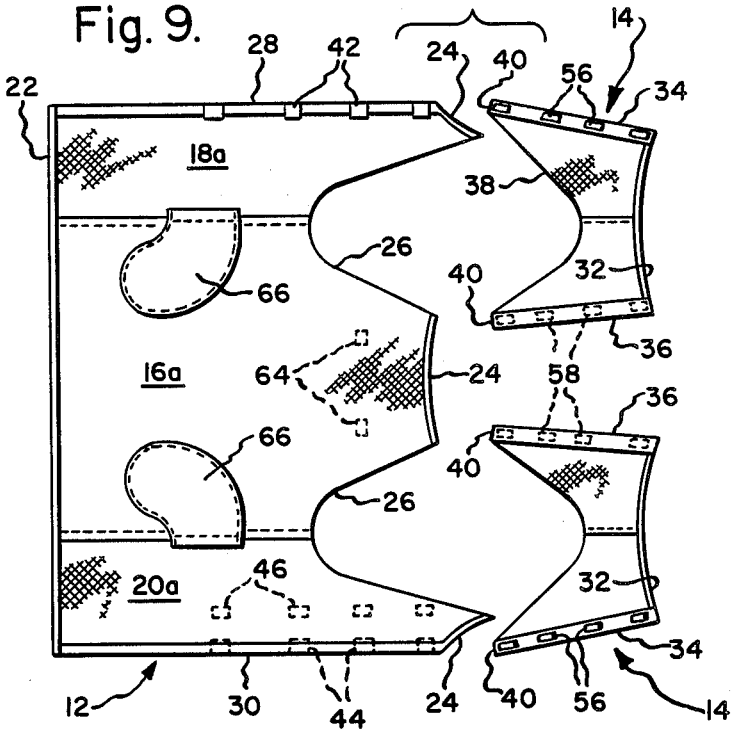
FIG. 9 is a partially disassembled view of the garment shown in FIG. 8.
Figure 10:
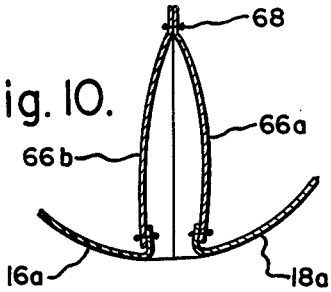
FIG. 10 is a section taken generally along line 10—10 in FIG. 8.

The body portion 12 of the embodiments shown in FIGS. 1–7, and as best shown in FIG. 2, is formed from a single piece of material and includes a main panel 16 and side panels 18 and 20. In the embodiment of FIGS. 8, 9, and 10, the body portion 12 is formed from three pieces of material and includes a main panel **16*a*, and side panels 18*a* and 20*a*. These panels are suitably sewn together in a manner which will be referred to later. All of the main and side panels have a lower edge 22 and an upper edge which includes neck opening defining sections 24 and sleeve-attaching sections 26. The side panels are each provided with a marginal outer side edge which extends in a vertical direction when the garment is worn by a patient. Thus, side panel 18 or 18*a* is provided with a marginal outer side edge 28 and side panel 20 or 20*a* is provided with a marginal outer side edge 30. As can be seen from FIGS. 2 and 9 the body portion 12, before the sleeves 14 are sewn to it, has all of its edges hemmed except for the sleeve-attaching edges 26**.

Each of the sleeves is initially formed to the shapes indicated in FIG. 2 and are suitably hemmed. Each sleeve includes a lower edge 32, parallel side edges 34, 36, and an upper sleeve edge. A portion 38 of the upper sleeve edge is adapted to be secured to the sleeve-attaching section of the upper edge of the body portion. Another portion 40 of the upper sleeve edge forms a scooped neck opening. It should be apparent from an inspection of the various figures that after the sleeve portions 14 have been sewn to the body portion 12, the body portion upper edge sections 24 and the sleeve upper edge sections 40 cooperate with each other to define the entire neck opening. This design facilitates the assembly of the patient's garment and additionally facilitates the opening of the sleeves in a manner which will be more fully described below.

Before the sleeve portions 14 are assembled to the body portion 12, fasteners are secured to these various portions 12, 14. As can be seen from a comparison of the modification shown in FIG. 5 with the other modifications, two differing types of fasteners may be employed for the body portions; however, it is preferred that only a single type of fastener be utilized for the sleeve portions.

Referring now, in more detail, to the modification of FIGS. 1 through 4, the body portion, and particularly the side panels 18, 20 of the body portion, are secured to each other in an overlapping relationship when the garment is worn by the patient. There should be sufficient overlap of the garment to prevent the garment from gapping open during normal usage of the garment so that the patient wearing the garment should not feel that his or her body is unduly exposed. Accordingly, one column of vertically spaced apart X-ray transparent fasteners 42 are provided which are mounted on the inner surface of the side panel 18 adjacent the marginal edge 28. Each of these fasteners 42, which form a first column, are hook-forming pile threads in patches approximately 1–1½ inches in width and 1–1½ inches in height. Similarly, on the outer face of the side panel 20 adjacent the marginal edge 30, a plurality of fasteners 44 are sewn or otherwise secured to the garment, this plurality of fasteners 44 forming a second column. Each of the fasteners 44 is material approximately 1–1½ inches in width by 1–1½ inches in height, the material including loop-forming pile threads. The spacing between the fasteners 42 and between the fasteners 44, as well as their arrangement on fabric are so selected that they cooperate with each other. This type of fastener has been sold under the trade name "Velcro". The distance between the fasteners 42 and 44 is indicated by X in FIG. 1 and the overlap by Y. The X:Y ratio should not exceed 5:1. This will prevent undue gapping of the garment. In a preferred form, the distance between the various fasteners is approximately 7½ inches and the spacing is such that an overlap of 1½ to 2 inches when the garment is properly fastened. It should be noted that the fasteners 42,44 of the type described can be readily secured to each other by the application of moderate pressure and similarly can be readily disassembled by the application of a moderate pulling force. Also, such fasteners have been shown to have high durability when subject to commercial washing practices. Finally, this form of fastener is acceptable in a hospital as they are transparent to X-ray and additionally do not conduct electricity.

The body portion 12 has a width so selected that it is capable of being secured about virtually all patients including those patients who either are obese or are completing pregnancy. Since some patients may object to wearing such a loose garment, a third (and a fourth) column of fasteners 46 may be provided whereby the girth of the garment can be varied.

As can be seen from FIG. 1, the last or lowermost fastener 42 and/or 44 is spaced away from the lower edge 22 of the body portion, and this is simply for the purpose of providing a kick pleat.

Another form of fastener is illustrated in FIG. 5 for closing the body portion. In this figure the side panel fasteners are formed of fabric ties which are arranged in columns. The first column of ties 48 is secured to the edge 28 of the body portion. A second column of ties 50 is secured to the outer face of the body garment inwardly of the edge 30, and this column of ties is so spaced away from the edge 30 that there is a sufficient overlap to prevent gapping of the garment. Ties 52 and 54 are also provided on the garment to provide additional third and fourth columns. It should be apparent that the first column of ties 48 can be selectively secured to either the second column, third column, or fourth column of ties to accommmodate patients of varying girths.

With reference to all of the Figures, it should be noted that before the sleeve portions 14 are assembled onto the body portion, fasteners are provided along the edges 34, 36. These fasteners are of the same type employed for the side panels in the modification of FIGS. 1 through 4. Thus, a first column of spaced apart fasteners 56 are secured to the inner face of the sleeve 14 adjacent the edge 34, the fasteners being squares of hook-forming pile threads approximately 1–1½ inches in width and length. A corresponding second column of spaced apart fasteners 58 are secured to the other face of the sleeve portion 14 adjacent the edge 36, these fasteners being of loop-forming pile threads in squares approximately 1–1½ inches in width and length. When the fasteners 56 and 58 are secured to each other in the manner indicated in FIGS. 1, 4, 5, 6 and 8 the sleeve will be closed and the opposed edges will overlap. The spacing between the fasteners and the overlap preferably does not exceed the 5 to 1 ratio described above.

The patient's garment of the various modifications can be worn either as a hospital gown wherein the side panels are joined to each other along the patient's back in the manner indicated in FIG. 4. Alternatively, it can be worn as a housecoat wherein the side panels are joined to each other along the patient's front on the manner indicated in FIG. 3. Thus, the cut of the garment is sufficiently symmetrical that it can be worn either way. The neckline is a scoop design for both comfort and style. When the garment is worn as either a housecoat or as a gown, the sleeve length will be such that the lower edge extends below the patient's elbow and/or antecubital fossa. The reason for this is that the antecubital fossa frequently becomes discolored due to the application of needles to this area, which discoloration can be embarrassing to the patient. Thus, by covering the area which may be discolored the patient has a greater sense of self-esteem and dignity.

Figure 7:
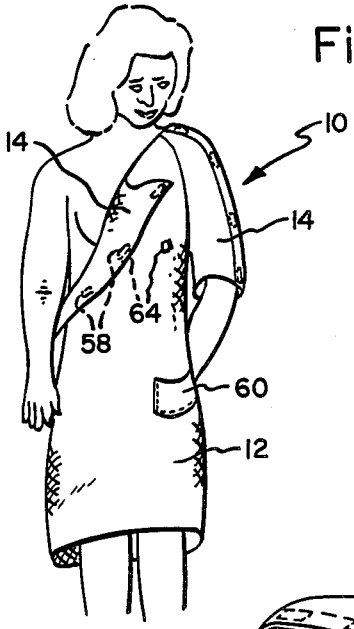
FIG. 7 is a view of the garment shown in FIG. 6 when worn as a gown, and with one of the sleeves being held open by a pectoral fastener.

Referring now to the modification shown in FIGS. 6 and 7, this differs from the modification of FIG. 1 in two principal respects. First, this modification is provided with a pair of patch pockets 60, 62. The patch pocket 60 is secured to the main body portion 16 whereas the patch pocket 62 is secured to the side panel 20. The reason the pockets are so located is that at least one pocket will be conveniently available to the patient when the garment is worn either as a hospital gown or as a housecoat.

The modification of FIG. 6 and FIG. 7, as well as the modification of FIGS. 8 through 10 additionally differs from the modification shown in FIG. 1 by the additional provision of pectoral fasteners 64 which are suitably located on the main panel 16 as illustrated in FIG. 6. These fasteners are formed of loop-forming pile material and are capable of being engaged by the second fastener 56 from the neck in the manner indicated in FIG. 7. When the gown is worn in this manner it is beneficial for breast feeding, breast examination, various radiological procedures, etc.

In the modification illustrated in FIGS. 8 through 10, the garment differs from the preceding figures principally in its construction, and more specifically in the provision of slash pockets 66. Each of the pockets 66 is formed of spaced apart pieces of material **66*a*, 66*b* which are suitably sewn to each other along a seam 68, and are also sewn to edge portions of the main panel 16*a* and side panels 18*a* or 20*a* in the manner indicated in FIG. 10. By making the body portion 12 of separate panels 16*a*, 18*a*, 20*a* the pockets 66** can be readily assembled.

It should be apparent from the above that the garment thus far described meets the requirements of doctors, patients, and hospital administrators. Thus, the garment will give the patient a much higher degree of comfort and dignity than is available with gown currently in widespread usage. By providing pockets it will not be necessary for the patient to pin objects to the gown for safekeeping which pins may be left in the garment and interfere with X-ray procedures.

In addition, the garment is also capable of being made of durable materials which will withstand extended hospital usage and cleanings, and a wide variety of sizes need not be stocked.

The present gown has been designed to fulfill virtually all medical requirements as well as those requirements established by the patient and hospital administrators. Thus, the garment can be worn during the taking of X-rays as the fasteners employed are transparent to X-ray. The garment can be worn into surgical suites as it does not contain any material which conduct electricity. Also, various examinations and medical procedures can be performed without removing the garment. To this end access can be gained to the patient by separation of various panel fasteners 42, 44 or 48, 50 and sleeve fasteners 56, 59. For example, if it were desired to take a patient's blood pressure 2, 3, or 4 of the sleeve fasteners 56, 58 could be released to permit a cuff to be placed about the patient's arm at a location above the patient's elbow while permitting the application of a stethoscope to the patient's antecubital fossa.

The present garment also provides for multiple positioning of patients undergoing various radiological tests such as various views of the shoulder, humerus, Glenoid process, acromioclavicular joint, axilla, scapula, etc. The radiographic tests can be performed either while the garment is in place or simply by removing the gown from the portion of the body which is subject to the tests. The garment can be removed with great facility by undoing some or all of the fasteners 42, 44 and 56, 58. The garment also permits easy accessibility to the placement of various EKG leads. A thorax or upper abdomen examination can be readily performed without removal of the entire gown by either opening the fasteners 56, 58 on one sleeve or both sleeves and one or more of the upper fasteners 42, 44. This can be done either for examination purposes or for the purposes of surgery.

Another advantage of the present garment is that is permits infants free access to the mother's breasts postnatally.

In many situations existing gowns are not suitable for use where various injuries have been treated. For example, when the patient has been subjected to a shoulder separation, the bandaging and strapping of the patient's shoulder and arm frequently makes it very difficult to utilize conventional hospital garments.

Many patients today are receiving treatment through a central venous pressure catheter and easy access if provided to the CVP catheter simply by undoing the fasteners 56, 58 on the right sleeve. Similarly, access can also be achieved to a Hickman catheter.

Other medical procedures which this gown facilitates are too numerous to mention, but it should be appreciated that access can be achieved to the whole body by undoing the various fasteners 42, 44 and 56, 58 which will literally permit the garment to fall away from the patient providing free access. Those portions which need not be undone for the procedures or examinations being performed can be left in place.

Additionally, the gown can easily be removed when the patient in undergoing I.V. treatment, which is customarily administered to a location on the arm, simply by undoing the fasteners 56, 58 on that arm as well as the fasteners 42, 44 which will permit removal of the entire gown without disturbing the I.V. treatment.

While preferred garments in which the principles of the present invention have been incorporated are shown and described above, it is to be understood that this invention is not to be limited to the particular details shown and described above, but that, in fact, alternative designs may be employed in the broader aspects of this invention.

What is claimed is:

1. A patient's garment which may be worn with comfort and dignity as either a housecoat or a gown and which is suitable for use for prolonged convalescence, the garment also permitting a wide variety of medical procedures, such as X-ray, to be performed without removal of the garment and which will also permit continuation of medical procedures while the garment is being removed; said garment comprising:

a body portion which is adapted to be worn about the upper abdomen and thorax of a patient and extend from the patient's neck to about the knees of the patient, the body portion including a main panel adapted to cover one side of a patient and a pair of adjacent side panels adapted to cover the other side of the patient, each of the side panels having a generally vertically extending marginal edge, the main panel and side panels having a lower edge and an upper edge, the upper edge having sleeve-attaching sections and neck opening defining sections;

first and second columns of vertically spaced apart X-ray transparent panel fasteners mounted on the side panels adjacent the marginal edges and being capable of holding the side panels together in overlapping relationship;

a third column of vertically spaced apart X-ray transparent panel fasteners mounted on one of the side panels in parallel relationship to one of the columns of vertically spaced apart panel fasteners, the third column of panel fasteners being capable of cooperating with the other one of said first and second columns of panel fasteners to permit the girth of the garment to be varied;

a pair of sleeves, each sleeve having an upper sleeve edge, parallel side edges, and a lower edge, at least a portion of the upper sleeve edge being secured to the sleeve-attaching section of the upper edge of the panels of the body portion, the parallel side edges normally extending from the patient's neck over the patient's shoulder and down the arm of the patient to the lower sleeve edge, and the lower sleeve edge normally being disposed at a location below the patient's antecubital fossa; and first and second columns of spaced apart X-ray transparent sleeve fasteners mounted on each sleeve adjacent the parallel side edges and capable of holding the parallel side edges of the sleeve together in overlapping relationship in a normal position, said sleeve fasteners being of the type having cooperating hook-forming pile threads and loop forming pile threads and which can be quickly secured together through the application of pressure and which can be quickly released through the application of a moderate pulling force.

2. The hospital garment as set forth in claim 1 wherein the panel fasteners are of the type having cooperating hook-forming pile threads mounted adjacent one edge and loop-forming pile threads mounted adjacent the other edge, and which can be quickly secured together through the application of pressure and which can be quickly released through the application of a moderate pulling force.

3. The patient garment as set forth in claim 3 wherein each of the panel and sleeve fasteners includes a patch approximately 1 to 1½ inches in width and length.

4. The patient's garment as set forth in claim 1 wherein the panel fasteners are formed of fabric ties.

5. The patient's garment as set forth in claim 1 wherein the side panels overlap a first distance which is at least one-fifth the distance between the spaced apart panel fasteners.

6. The patient's garment as set forth in claim 1 wherein the side panels overlap at least 1½ inches and the spacing between the panel fasteners does not exceed 7½ inches.

7. The patient's garment as set forth in claim 1 wherein the garment is made of a material having an opacity of such a degree as to give the average patient a feeling of privacy.

8. The patient's garment as set forth in claim 1 wherein the material of the patient's garment is selected so as to provide suitable thermal characteristics when sleeping and also when moving about a hospital from one location to another.

9. The patient's garment as set forth in claim 1 wherein the garment is made of a fabric material having a degree of opacity which gives the average patient a feeling of privacy.

10. The patient's garment as set forth in claim 9 wherein the thermal characteristics of the fabric are such that the patient is comfortable during the night when sleeping and also when moving about from place to place within the hospital.

11. The patient's garment as set forth in claim 9 wherein the garment is provided with pockets.

12. A patient's garment which may be worn reversibly and with comfort and dignity and which is suitable for prolonged convalescence, the garment also permitting a wide variety of medical procedures, such as X-ray, to be performed without removal of the garment and which will also permit continuation of medical procedures while the garment is being removed; said garment comprising:

a body portion which is adapted to be worn about the upper abdomen and thorax of the patient and extend from the patient's neck to about the knees of the patient, the body portion including a centrally located main panel adapted to cover one side of the patient and a pair of adjacent side panels adapted to cover the other side of the patient, each of the side panels having a generally vertically extending marginal edge, the main panel and side panels having a lower edge and an upper edge, the upper edge having sleeve-attaching sections and neck opening defining sections;

first and second columns of X-rays transparent panel fasteners mounted on the side panels adjacent the marginal edges and being capable of holding the marginal edges together in an overlapping relationship;

a pair of sleeves, each sleeve having an upper sleeve edge, parallel side edges, and a lower edge, at least a portion of the upper sleeve edge being secured to the sleeve-attaching section of the upper edge of the panels of the body portion, the parallel side edges normally extending from the patient's neck, over the patient's shoulder, and down the arm of the patient to a lower sleeve edge, and the lower sleeve edge normally being disposed at a location below the patient's antecubital fossa;

first and second columns of spaced apart X-ray transparent sleeve fasteners mounted on each sleeve adjacent the parallel side edges and capable of holding the parallel side edges of the sleeve together in an overlapping relationship when in the normal fastened position; and a pair of pectoral fasteners mounted on the main panel of the body portion, each of said pectoral fasteners being capable of cooperating with a sleeve fastener to maintain the associated sleeve in its open position;

the panel fasteners, the sleeve fasteners and the pectoral fasteners each being of the type having cooperating hook-forming pile threads and loop-forming pile threads.

13. The patient's garment as set forth in claim 12 wherein the fsteners in each of the first and second columns are spaced apart from each other at a distance not greater than 7½ inches, the first and second columns being capable of holding the marginal edges together in an overlapping relationship by at least 1½ inches.

14. The patient's garment s set forth in claim 12 wherein the neck opening defining sections define a neckline of scoop design.

* * * * *

UNITED STATES PATENT AND TRADEMARK OFFICE

CERTIFICATE OF CORRECTION

PATENT NO. : 4,570,268

DATED : February 18, 1986

INVENTOR(S) : James J. Freeman

It is certified that error appears in the above-identified patent and that said Letters Patent are hereby corrected as shown below:

Claim 9, col. 9, line 27, "1" should be --12--.

Claim 11, col. 9, line 36, "9" should be --12--.

Claim 13, col. 10, line 41, "fsteners" should be --fasteners--.

Claim 14, col. 10, lin4 46, "s" should be --as--.

Signed and Sealed this

*First* Day of *July 1986*

[SEAL]

*Attest:*

DONALD J. QUIGG

*Attesting Officer*

*Commissioner of Patents and Trademarks*